US005287559A

United States Patent [19]

Christiansen et al.

[11] Patent Number: 5,287,559

[45] Date of Patent: Feb. 22, 1994

[54] CAP STRAP COVER COMFORTER

[75] Inventors: David M. Christiansen; Jeffrey A. Murray, both of St. Paul, Minn.

[73] Assignee: CM Marketing Group, Inc., Edina, Minn.

[21] Appl. No.: 900,112

[22] Filed: Jun. 18, 1992

[51] Int. Cl.[5] ..... A42B 5/00

[52] U.S. Cl. ..... 2/181; 2/DIG. 11; 2/209.13

[58] Field of Search ..... 2/171, 171.4, 171.5, 2/171.7, 171.8, 181, 181.2, 181.4, 181.6, 183, 195, 196, 197, 199, 209.1, 417, 418, 422, DIG. 11

[56] References Cited

U.S. PATENT DOCUMENTS

| | | | |
|---|---|---|---|
| Re. 33,430 | 11/1990 | Nunnery | 2/181 |
| 4,856,116 | 8/1989 | Sullivan | 2/181 |
| 4,941,210 | 7/1990 | Konucik | 2/DIG. 11 |
| 5,003,640 | 4/1991 | Pizzacar | 2/197 |
| 5,161,259 | 11/1992 | Shorts | 2/199 |

*Primary Examiner*—Clifford D. Crowder
*Assistant Examiner*—Diana L. Biefeld

[57] ABSTRACT

A fabric-covered foam rubber pad that is in a semicircular shape with a small slot gap in the center of the foam rubber pad that provides a hinge to allow it to easily fold in half and provide room for the sizing strap of a baseball-style cap. Hooh-and-loop fasteners are attached to one side of the structure so that when placed up, under, and over a baseball-style cap's sizing strap it can be folded in half and secured in place.

2 Claims, 3 Drawing Sheets

CAP STRAP COVER COMFORTER

BACKGROUND

1. Field of Invention

This invention relates to a baseball-style cap, specifically to improve the comfort of the sizing strap found on the back side of a baseball-style cap.

2. Prior Art

None found.

BACKGROUND

The cap strap cover comforter was invented to eliminate the uncomfortable plastic, leather, or other sizing strap designs on baseball-style caps. Since there is no prior art this can only be specific toward the uncomfortable design of the sizing strap itself.

When wearing a baseball-style cap forward or backward the sizing strap is not comfortable when exposed to a bare forehead or to the back portion of a person's head or upper neck. Consequently the purpose of the cap strap cover comforter is to pad the area in which the sizing strap has always been uncomfortable and at times will leave an impression or mark on one's bare skin. The cap strap cover comforter is composed of a pad covered with fabric that folds up, under and over the sizing strap of a baseball-style cap, fastening together opposite the fold. Furthermore, today's baseball-style cap is worn more frequently backward than in the past, exposing the sizing strap to a person's forehead and, in most accounts, bare skin.

OBJECTS AND ADVANTAGES

Accordingly, several objects and advantages of my invention are:

(a) when wearing a baseball-style cap forward or backward my cap strap cover comforter covers the hole or gap that is open above the sizing strap, providing added protection from undesirable weather—be it rain or cold temperatures;

(b) the cap strap cover comforter keeps the sizing strap from digging into a person's bare skin, thus eliminating the strap imprint on the person's head when the baseball-style cap is taken off;

(c) the cap strap cover comforter provides a means to absorb perspiration;

(d) the cap strap cover comforter offers a person the means to make two statements while wearing a baseball-style cap—the logo or slang saying provided on the cap strap cover comforter (i.e., NBA logos, NFL logos, college names, favorite soft drinks, etc.) in addition to what the baseball-style cap may already say on the front side;

(e) the cap strap cover comforter can be used on any and all baseball-style caps that have sizing straps.

Further objects and advantages are to provide a simple-to-use, inexpensive, novel product that can represent a special event or team logo without the expense of purchasing a whole baseball cap. Still further objects and advantages will become apparent from a consideration of the ensuing descriptions and drawings.

REFERENCE NUMERALS

Figure 1:
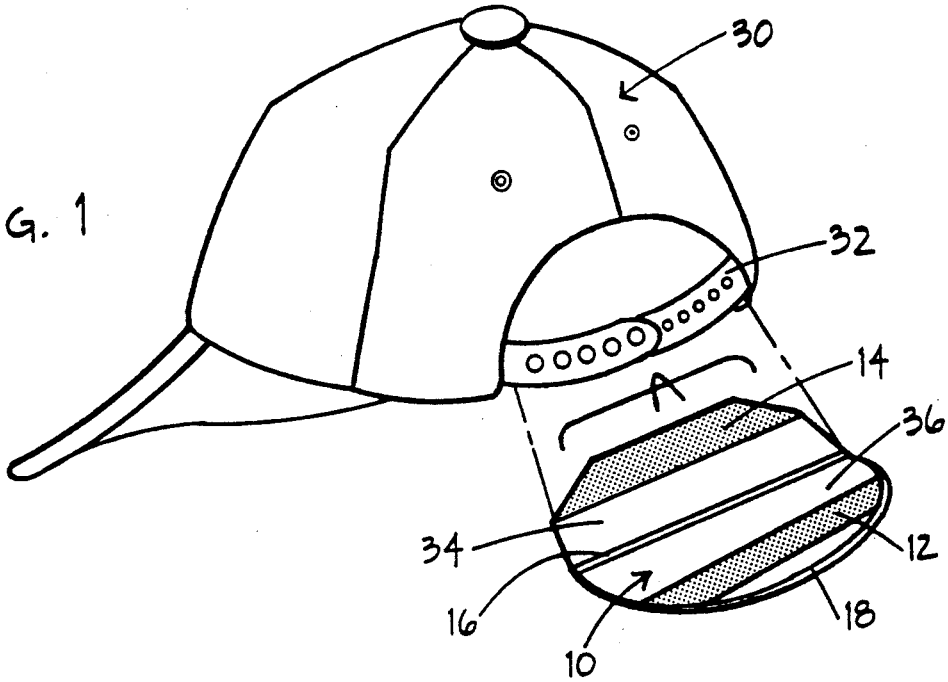
FIG. 1 is a perspective view of a baseball-style cap with cap strap cover comforter separated from the plastic style sizing strap.
Figure 2:
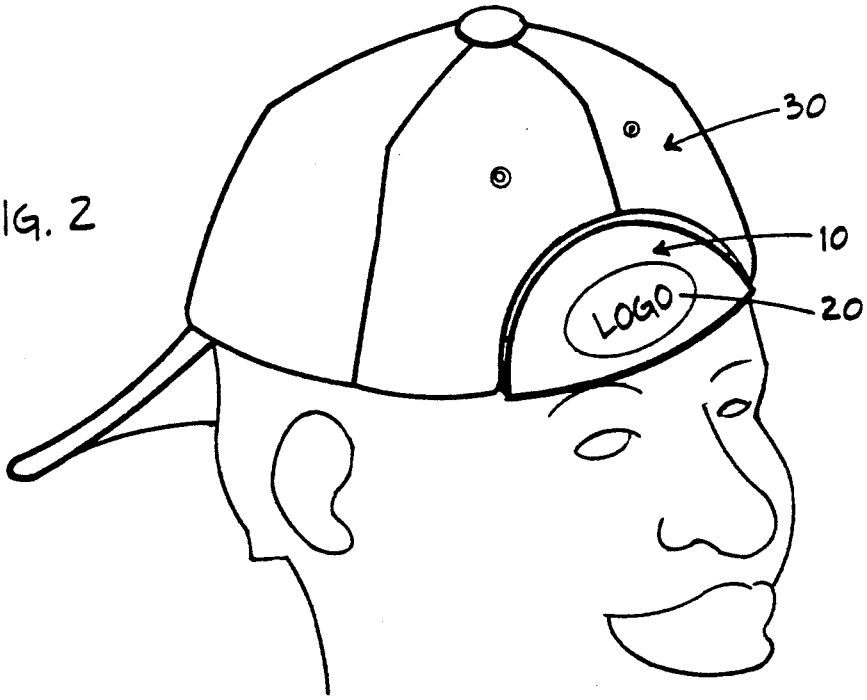
FIG. 2 is a perspective view of the cap strap cover comforter attached to the sizing strap of a baseball-style cap and in a fastened state.

10 the cap strap cover comforter
12 hook component of hook-and-loop
14 loop component of hook-and-loop
16 double seam stitch
18 bias tape trim
20 front logo space
22 back cover fabric
24 pad substraight structure
26 hinge gap
28 front cover fabric
30 baseball-style cap
32 baseball-style cap sizing strap
34 inside lower portion of cap strap cover comforter
36 inside upper portion of cap strap cover comforter

DETAILED DESCRIPTION AND OPERATION OF THE PREFERRED EMBODIMENT

FIG. 1 shows a perspective view of the cap strap cover comforter 10 separated from a baseball-style cap 30 and its sizing strap 32. The baseball-style cap sizing strap 32 illustrated is a plastic snap-style sizing strap. It should be understood that there are sizing straps that are constructed in different forms and are not illustrated here. These other styles of sizing straps have the same function, and when the cap strap cover comforter 10 is applied and fastened its function is the same as illustrated here.

Figure 3:
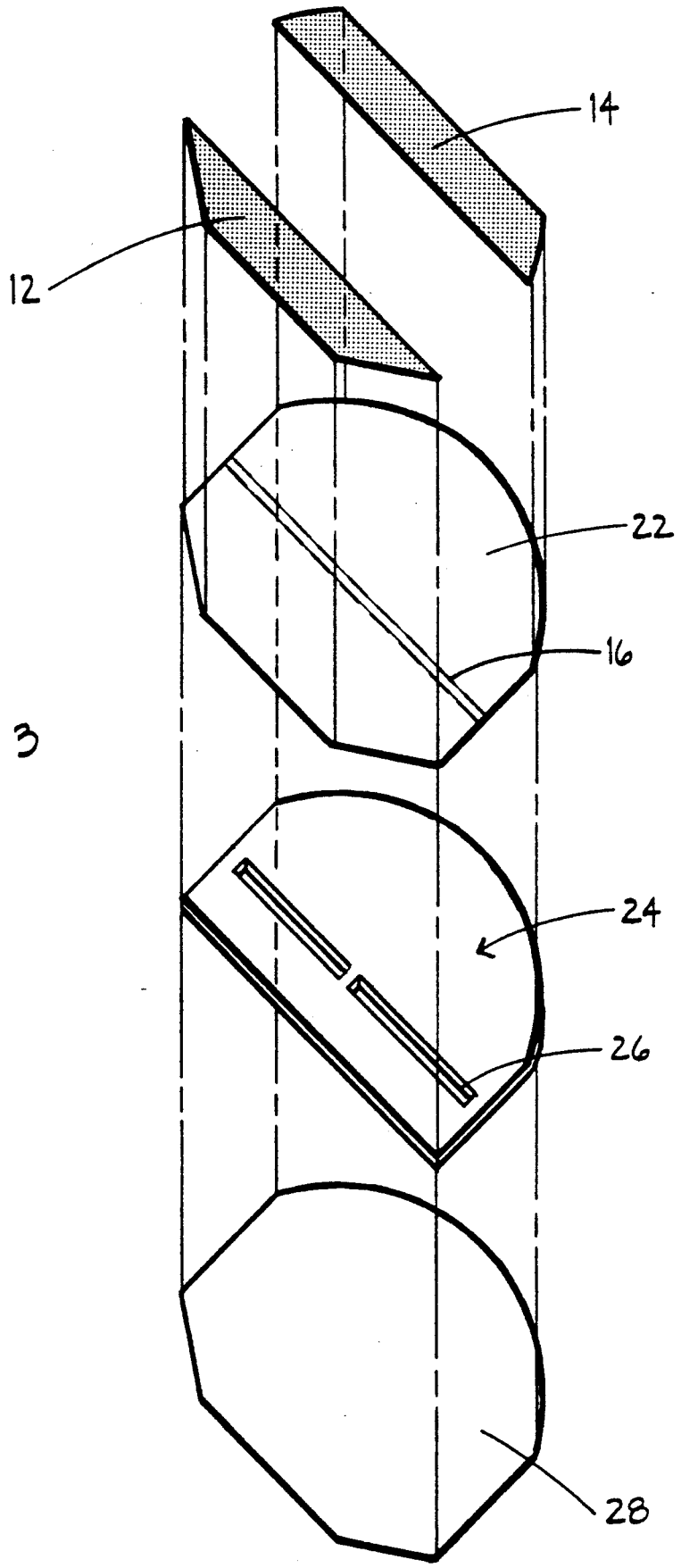
FIG. 3 is an exploded view of the cap strap cover comforter, illustrating the layers of construction.
Figure 5:
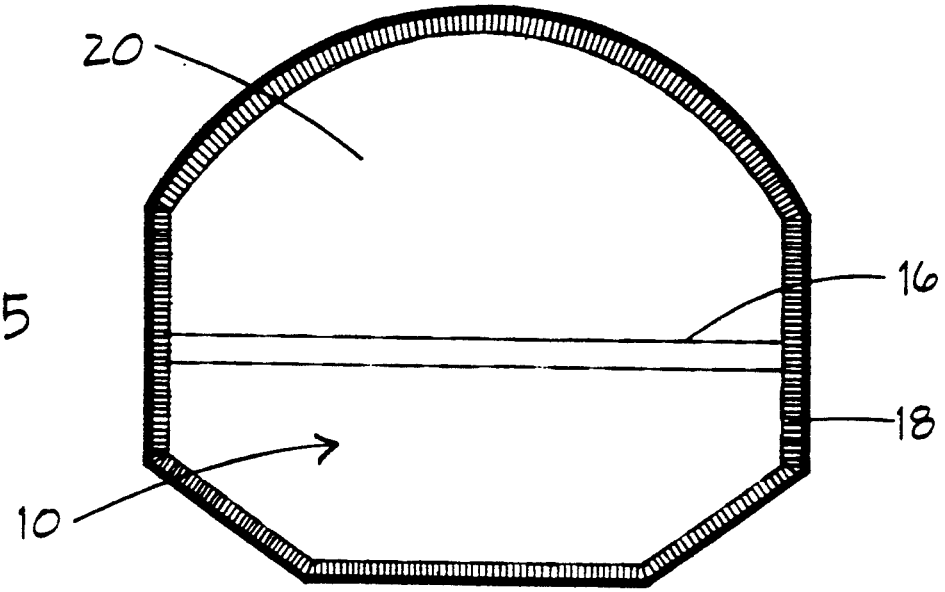
FIG. 5 is an elevated view of the cap strap cover comforter outside front side portion.

The cap strap cover comforter 10 and its construction is best illustrated in the exploded view shown in FIG. 3. A semi-circle pad substraight structure 24 with a cut-out gap in the middle section 26 provides a hinge means for folding. The front and back cover fabric 22, 28 are joined together by both a double-seamed stitch 16 and bias tape 18 when sewn around the outer edges of the front and back cover fabric 22, 28 and the pad substraight structure 24. FIG. 5 best illustrates the above description.

The front and back cover fabric can be any of a variety of different fabric materials including leather, a cotton/polyester blend, or a twill material. The criteria for the fabric must take into consideration the application of a logo or decoration on the space provided on the front side of the cap strap cover comforter 20. A cotton/polyester blend can be embroidered, silk-screened, or have heat-sealed patch capabilities.

Figure 4:
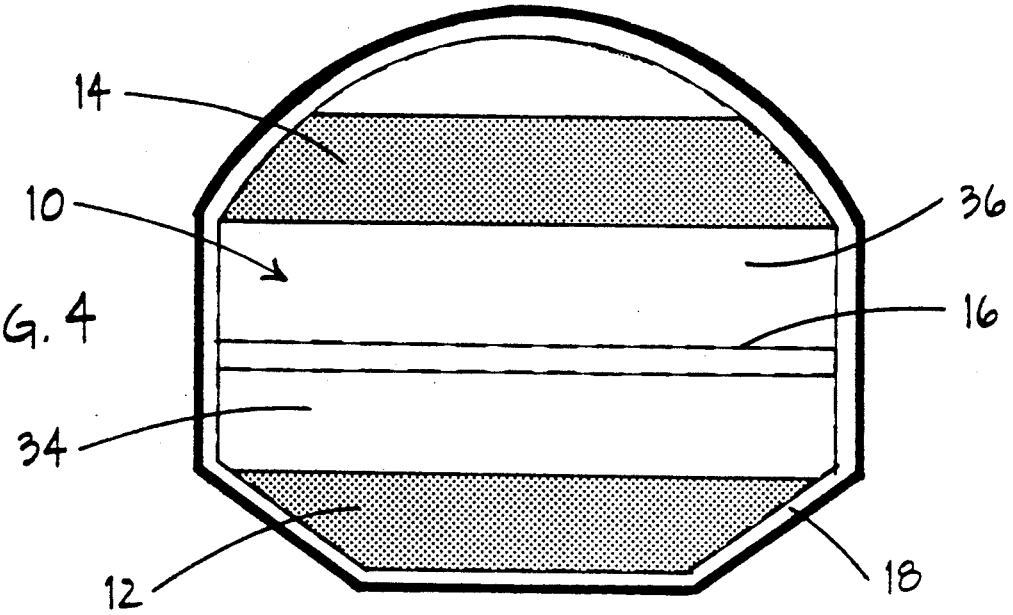
FIG. 4 is an elevated view of the cap strap cover comforter inside back side portion.

Once the above cap strap cover comforter 10 structure is in place, hook-and-loop fasteners 12, 14 are sewn on the back cover fabric 22. The hook portion 12 is sewn onto the lower portion where the angled cuts are. FIG. 4 best illustrates the above description. The loop portion 14 is sewn approximately ½" below the crest of the top circular portion on the back fabric cover portion 14.

To apply the cap strap cover comforter 10 onto the cap sizing strap 32, place the inside lower portion 34 facing up, towards the inside of the baseball-style cap 30 and under the sizing strap. Place the hinged gap 26 double seam stitched 16 directly under the cap sizing strap 32. Fold the cap strap cover comforter 10 in an upward motion and secure the hook 12 and loop 14 firmly together.

Although the present invention has been described with reference to preferred embodiments, workers skilled in art will recognize that changes may be made in form and detail without departing from the spirit and scope of the invention.

CONCLUSION, RAMIFICATIONS, AND SCOPE OF INVENTION

Thus the reader will see that my cap strap cover comforter device invention provides many functions in addition to covering an unattractive, uncomfortable sizing strap; it provides padded comfort, protection from weather, absorption of perspiration, and the ability to make a statement other than the logo already on the cap.

While the above description contains many specifications, these should not be construed as limitations on the scope of the invention, but rather as an exemplification of the preferred embodiment thereof Many other variations are possible. For example, the fastening device which secures and closes the cap strap cover comforter onto the cap sizing strap can be buttons, snaps, zippers, or hook-and-loop. The trim on the cap strap cover comforter edges can be pre-formed by surging, purled, morrowed, bias taped. The pad core substraight structure can be any closed- or open-pore spongelike material, foam rubber, or the like. Many fabrics can be used—cotton/poly, leather, or cotton twill, to name a few. Accordingly, the scope of the invention should be determined not by the embodiments but by the append claims and their legal equivalents.

What is claimed is:

1. A cap strap cover device and cap combination having a hemispheric opening adjacent the sizing strap, the cover comprising:

a multiple-ply padded structure having a first portion and a second portion, the first and second portions being joined by a hinge formed by a plurality of generally parallel stitched seams for allowing the first and second portions to fold relative to one another into a folded position around the cap sizing strap in a semicircular pattern substantially covering the hemispheric opening in the cap;

fastening means for holding the padded structure in the folded position around the cap sizing strap, the fastening means including a hook and loop fastener having a first strip attached at a lower end of the second portion of the padded structure and a second strip, generally parallel to the first strip, attached to a central area of the first portion of the padded structure so the first and second strips contact one another when in the folded position;

the padded structure including a display surface having a symbol displayed thereon, the display surface being located on the padded structure so that the symbol is visible when the padded structure is in the folded position.

2. In combination, a cap having a front portion with a bill and a rear portion with a hemispheric opening and a sizing strap for sizing the cap, and a foldable strap cover for covering the sizing strap, the foldable strap cover comprising:

a padded structure having a first portion and a second portion, the first and second portions being joined by hinge means formed by stitches separating the first and second portions for allowing the first and second portions to fold relative to one another, into a folded position around the cap sizing strap substantially covering the hemispheric opening;

a fastening means for holding the padded structure in a folded position around the cap sizing strap, the fastening means including a hook and loop fastener having a first strip attached at a lower end of the second portion of the padded structure and a second strip, generally parallel to the first strip, attached to a central area of the first portion of the padded structure so the first and second strips contact one another when in the folded position; and the padded surface including a plyable display surface displaying a symbol thereon, the plyable display surface being positioned on the foldable strap cover so that the symbol is visible when the padded structure is in the folded position.

* * * * *